US010636269B2

(12) United States Patent
Lacy

(10) Patent No.: US 10,636,269 B2
(45) Date of Patent: Apr. 28, 2020

(54) HAZARDOUS CONDITION DETECTOR WITH WIRELESS COMMUNICATION INTERFACE

(71) Applicant: Terry Lacy, Macon, GA (US)

(72) Inventor: Terry Lacy, Macon, GA (US)

(73) Assignee: Thompson IP, LLC, Macon, GA (US)

( * ) Notice: Subject to any disclaimer, the term of this patent is extended or adjusted under 35 U.S.C. 154(b) by 0 days.

(21) Appl. No.: 16/376,607

(22) Filed: Apr. 5, 2019

(65) Prior Publication Data

US 2019/0311595 A1 Oct. 10, 2019

Related U.S. Application Data

(60) Provisional application No. 62/654,122, filed on Apr. 6, 2018.

(51) Int. Cl.

| | |
|---|---|
| ***G08B 21/02*** | (2006.01) |
| ***G08B 25/01*** | (2006.01) |
| ***G08B 25/00*** | (2006.01) |
| ***G08B 5/36*** | (2006.01) |
| ***G08B 27/00*** | (2006.01) |
| ***G08B 3/10*** | (2006.01) |
| ***G08B 26/00*** | (2006.01) |

(52) U.S. Cl.

CPC ..... *G08B 21/02* (2013.01); *G08B 3/1016* (2013.01); *G08B 5/36* (2013.01); *G08B 25/008* (2013.01); *G08B 25/016* (2013.01); *G08B 26/007* (2013.01); *G08B 27/005* (2013.01)

(58) Field of Classification Search

CPC ..... G08B 21/02; G08B 3/1016; G08B 5/36; G08B 25/008; G08B 25/016; G08B 26/007; G08B 27/005

USPC ..... 340/540

See application file for complete search history.

(56) References Cited

U.S. PATENT DOCUMENTS

| | | | | |
|---|---|---|---|---|
| 9,183,731 | B1 * | 11/2015 | Bokhary | G08B 25/10 |
| 2008/0048873 | A1 * | 2/2008 | Araiza-Boys | G08B 3/10 340/601 |
| 2011/0057801 | A1 * | 3/2011 | Logan | G08B 25/08 340/584 |
| 2013/0084923 | A1 * | 4/2013 | Schuman | H04W 4/00 455/567 |
| 2015/0065078 | A1 * | 3/2015 | Mejia | G08B 17/00 455/404.1 |
| 2015/0096352 | A1 * | 4/2015 | Peterson | F24F 11/30 73/31.02 |
| 2017/0086610 | A1 * | 3/2017 | Ross | A47G 19/2227 |
| 2017/0150304 | A1 * | 5/2017 | Baldasare | H04W 8/18 |
| 2018/0350223 | A1 * | 12/2018 | Banczak | G08B 25/001 |

* cited by examiner

*Primary Examiner* — Kerri L McNally

(74) *Attorney, Agent, or Firm* — Jason T. Daniel, Esq.; Daniel Law Offices, P.A.

(57) ABSTRACT

A hazardous condition detection device includes a small and lightweight main body having connectors along one side for securement to a building wall or ceiling. A detection unit is positioned within the main body and includes sensors such as a smoke detection sensor, a heat detection sensor, a carbon monoxide sensor, a radon detection sensor, a natural gas detection sensor, and/or a propane detection sensor. An alarm unit is positioned within the main body for generating an audiovisual alarm indication. A controller having a wireless interface is positioned within the main body and communicates with an externally located processor enabled device.

12 Claims, 3 Drawing Sheets

HAZARDOUS CONDITION DETECTOR WITH WIRELESS COMMUNICATION INTERFACE

CROSS-REFERENCE TO RELATED APPLICATIONS

This application claims the benefit of U.S. Application Ser. No. 62/654,122 filed on Apr. 6, 2018, the contents of which are incorporated herein by reference.

TECHNICAL FIELD

The present invention relates generally to electronic safety systems, and more particularly to a hazardous condition detector that can interface with an external wireless device.

BACKGROUND

The statements in this section merely provide background information related to the present disclosure and may not constitute prior art.

There are many commercially available systems for detecting hazardous conditions such as smoke or carbon monoxide, for example. Such systems are designed to include a compact main body that can be easily secured to a wall or ceiling unobtrusively, and to activate an onboard siren upon detection of the harmful substances. These systems are designed to operate independently and for several such devices to be provided throughout a structure so that a failure in any one system still results in notification to the building occupants so as to allow the occupants to evacuate and call for help.

Although these small, lightweight independent detectors have undoubtedly saved hundreds if not thousands of lives, they still rely on a person to manually contact first responders or other appropriate agencies to investigate and cure the root cause of the alarm.

Although complex integrated systems may exist that utilize a plurality of networked detection devices that communicate with a centralized controller which can alert an alarm monitoring company, such systems are extremely costly, require extensive physical network resources and ongoing monitoring services that are simply not palatable for the average household.

Accordingly, it would be beneficial to provide a hazardous condition detector having a wireless communication unit capable of identifying hazardous conditions and independently notifying a third party, without the drawbacks described above.

SUMMARY OF THE INVENTION

The present invention is directed to a hazardous condition detection device. One embodiment of the present invention can include a small and lightweight main body having connectors along one side for securement to a building wall or ceiling. The device can include a detection unit for detecting hazardous conditions, the detection unit can include one or more sensors such as a smoke detection sensor, a heat detection sensor, a carbon monoxide sensor, a radon detection sensor, a natural gas detection sensor, and/or a propane detection sensor.

The device can include an alarm unit for generating one or both of an audible and visual alarm indication. The device can also include a controller having a wireless interface. The controller can include functionality for communicating with an external device directly, over a network and/or through a mobile application. The controller can also receive instructions from the external device. In various instances, the wireless interface can directly communicate notifications of detected hazardous conditions to a user-specified contact list.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described herein, the term "hazardous condition" for which the device can be constructed to detect include, but are not limited to the presence of smoke, fire, heat, radon, carbon monoxide, natural gas and/or propane, for example. Of course, other embodiments of the device are contemplated for detecting additional and/or specific conditions based on newly discovered science and/or particular environmental conditions for which the unit is designed to operate. For example, some units may be equipped with radiation sensor(s) for use at locations nearby to nuclear power plants.

Figure 1:
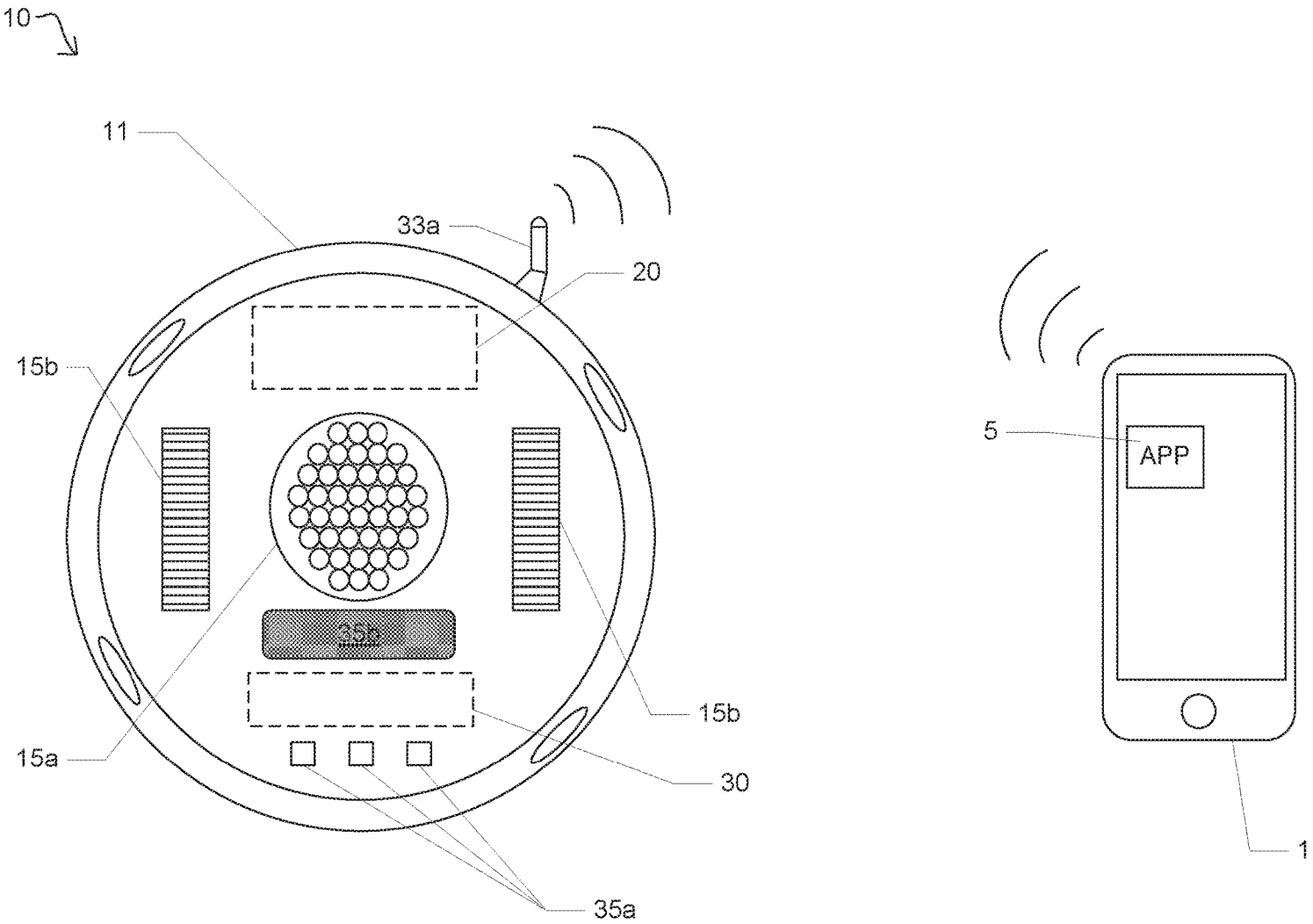
FIG. 1 is a perspective view of a hazardous condition detector device that is useful for understanding the inventive concepts disclosed herein.
Figure 2:
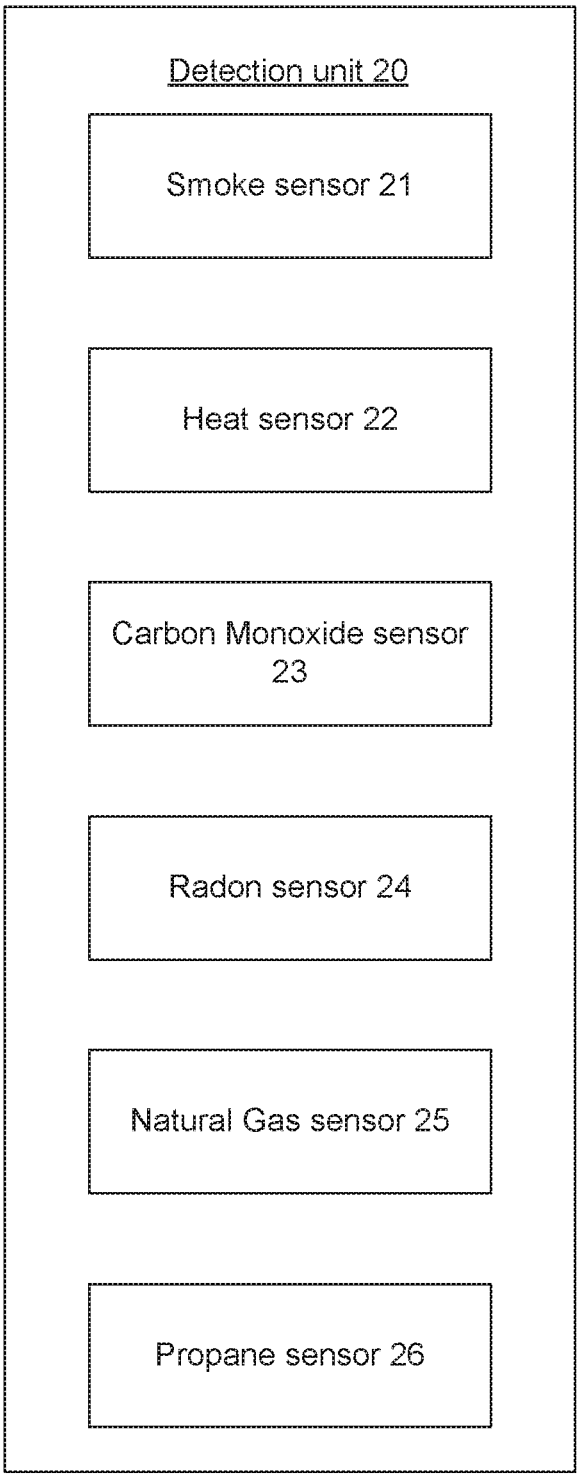
FIG. 2 is a simplified block diagram of a detection unit of the hazardous condition detector device, in accordance with one embodiment of the invention.
Figure 3:
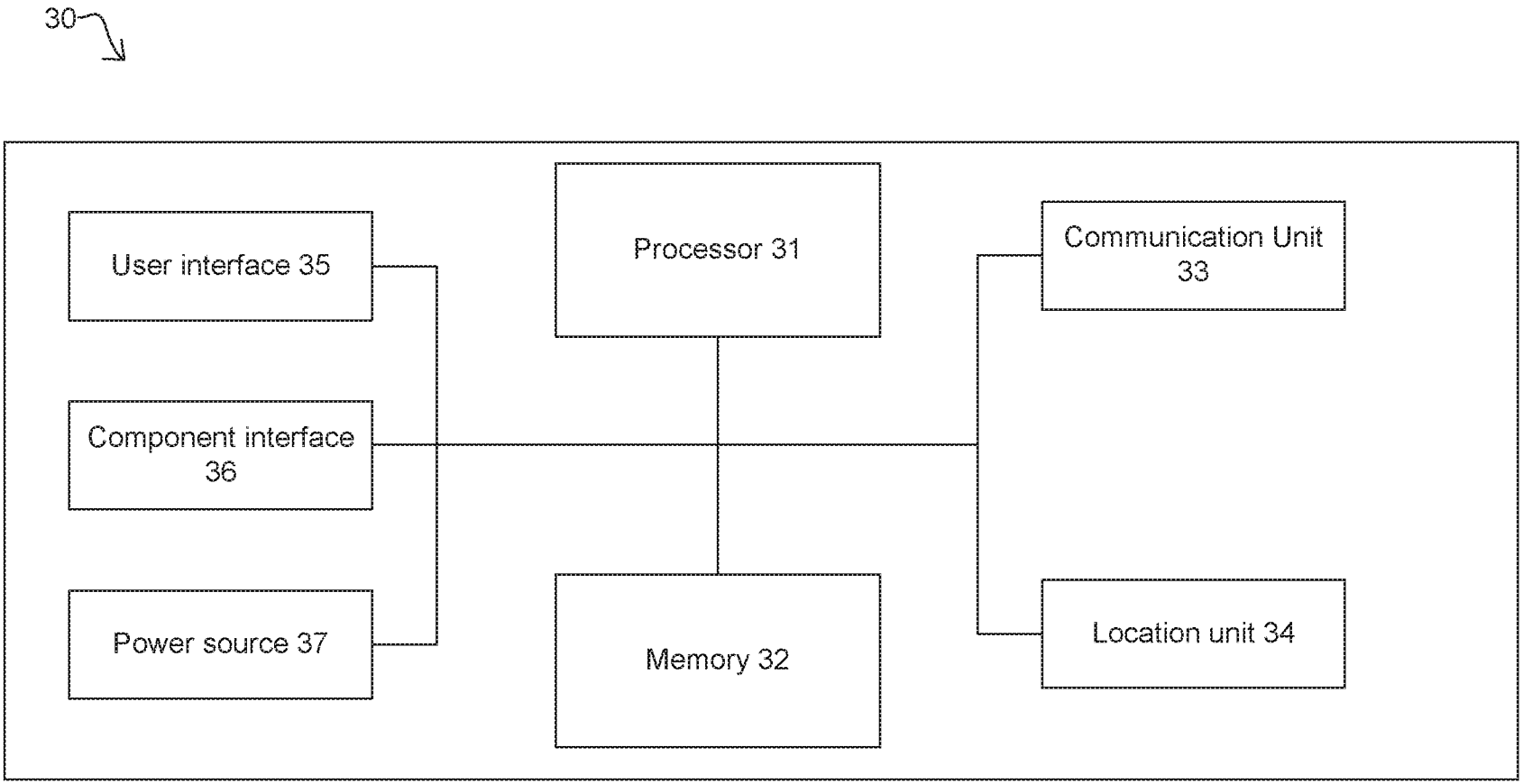
FIG. 3 is a simplified block diagram of the internal controller of the hazardous condition detector device, in accordance with one embodiment of the invention.

FIGS. 1-3 illustrate one embodiment of a hazardous condition detector 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical,"

"horizontal," and derivatives thereof shall relate to the invention as oriented in FIG. 1.

As shown in FIG. 1, the device 10 can include, essentially, a main body 11 that houses an alarm unit, a detection unit 20, and a control and communication unit 30.

As described herein, the main body 11 can include any number of different shapes and sizes and can be constructed from any number of different materials suitable for encompassing each of the controller elements. In one preferred embodiment, the main body 11 can be constructed from lightweight injection molded plastic having a plurality of internal connectors (not shown) for securely housing each of the device elements. Of course, any number of other known construction materials such as PVC and composites, for example, are also contemplated.

As the device 10 is intended to replace conventional smoke detectors within a building, it is preferred that the finished device include similar dimensions. To this end, the device can preferably include a small unobtrusive footprint of less than 8 inches, and a total weight of between 8 and 12 ounces, for example. Although not illustrated, the back surface of the main body can include any number of different brackets or receivers for engaging mounting hardware such as screws, for example.

The alarm unit can include any number of different devices capable of providing an audible and/or visual indication to a user. For example, the alarm unit can include a speaker/siren 15*a* and one or more lights 15*b* that can be selectively activated by the controller 30 upon detection of a hazardous condition by the detection unit 20. The device can also include a display screen 35*b* which can display operating information, alarm conditions and power levels, for example.

In one embodiment, the alarm unit can include functionality for describing the particular type of environmental condition detected. For example, if smoke is detected, the speaker can say "WARNING SMOKE DETECTED" and the light can flash red, whereas if carbon monoxide is detected the speaker can say "WARNING CARBON MONOXIDE DETECTED" and the light can flash green. Of course, any number of other spoken words, sounds and visual indicators are also contemplated.

The detection unit 20 can be positioned within the main body 11 and can include one or more sensors capable of detecting a hazardous condition. As shown best in FIG. 2, the detection unit 20 can include one or more sensors such as a smoke detection sensor 21, a heat detection sensor 22, a carbon monoxide sensor 23, a radon detection sensor 24, a natural gas detection sensor 25, and/or a propane detection sensor 26. Each of the sensors 21-26 can be constructed in accordance with known manufacturing processes. For example, the smoke detector 21 may employ ionization or photoelectric sensors, the heat detector 22 may employ a thermostatic sensor, the carbon monoxide detector 23 may employ a metal oxide semiconductor sensor, the radon detector 24 may employ a photodiode impact sensor, and the gas detector(s) 25 and 26 may employ catalytic and infrared sensors to detect combustible gasses.

FIG. 3 illustrates one embodiment of a system control unit 30, that includes a processor 31 that is conventionally connected to an internal memory 32, a wireless interface 33, a location detection unit 34, a user interface 35, a component interface unit 36 and/or a power source 37.

Although illustrated as separate elements, those of skill in the art will recognize that one or more system components may comprise or include one or more printed circuit boards (PCB) containing any number of integrated circuit or circuits for completing the activities described herein. The CPU may be one or more integrated circuits having firmware for causing the circuitry to complete the activities described herein. Of course, any number of other analog and/or digital components capable of performing the below described functionality can be provided in place of, or in conjunction with the below described controller elements.

The processing unit 31 can be a conventional central processing unit (CPU) or any other type of device, or multiple devices, capable of manipulating or processing information such as program code stored in the memory 32 in order to allow the device to perform the functionality described herein.

The memory 32 can act to store operating instructions in the form of program code for the processor 31 to execute. Although illustrated in FIG. 3 as a single component, memory 32 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device such as a hard drive, for example, containing programs that permit the processor to perform the functionality described below. Additionally, memory 32 can also include one or more cache memories that provide temporary storage of at least some program code in order to reduce the number of times program code must be retrieved from the bulk storage device during execution. Each of these devices are well known in the art.

The wireless interface 33 can include any number of components capable of sending and/or receiving electronic signals with an externally located device, either directly or over a network. In the preferred embodiment, the interface/communication unit 33 can include a cellular transceiver having an antenna 33*a* for sending and receiving signals over a cellular network.

Of course, any number of other known transmission and reception mechanisms and protocols can also be utilized herein, several nonlimiting examples include Bluetooth transceivers, Near-Field-Communication (NFC) devices, unique radio frequencies, and/or a network adapter for communicating over a WAN, LAN or the internet via an internet service provider, for example. To this end, the device may also include functionality for communicating directly with other safety systems, such as a FIRST RESPONSE LOCATOR SYSTEM, for example, as described in U.S. Pat. No. 9,928,702, to Bauldree. Of course, any number of other systems are also contemplated.

In one embodiment, the device 10 may be provided with a custom mobile application 5 (i.e., App) for execution on a processor enabled device 1 such as a smartphone or tablet, for example. The App can include functionality for allowing a user to send and receive information with the device. The information can include receiving alarm status indicators, providing contact(s) for the device to communicate with directly in designated alarm conditions, and other such functionality.

The location detection unit 34 can include any number of known devices capable of detecting the location of the device 10 so that the same can be communicated to an external device. In the preferred embodiment, the detection unit can interface with the cellular transceiver so as to utilize the cellular service provider to determine the device location (e.g., cellular localization). Of course, other embodiments are contemplated wherein other types of location identification systems are utilized, several nonlimiting examples include GPS location and signal strength triangulation which can be displayed on a mobile device running an App that is paired to the device 10, for example.

The user interface 35 can function to accept user inputs and/or to provide operating information to a device user. In various embodiments, the user interface can include or control one or more buttons 35*a*, switches, and/or a display 35*b* such as an LCD screen, for example, that are connected to the processor 31 so as to activate various programmatic functions (e.g., alarm test, power levels, WPS setup, Bluetooth Pairing). In addition to above, the user interface can include or control one or more communication ports such as a Universal Serial Bus or micro USB, for example, in order to send and receive information with another device via a direct communication link.

The component interface unit 36 can function to provide a communicative link between the processor 31 and various other device components such as the speaker 15*a*, lights 15*b* and buttons 35*a*, for example. In this regard, the component interface unit can include any number of different components such as one or more PIC microcontrollers, internal bus, USB connections and other such hardware capable of providing a direct link between the various components. Of course, any other means for providing the two-way communication between the identified components can also be utilized herein.

The power source 37 can include any number of different components capable of providing the necessary power requirements to each element of the system. To this end, the power source can include or comprise any number of different batteries and/or can include functionality for engaging A/C electrical power in the building to which the device is to be installed.

In operation, the device 10 can be installed at any desirable location within a building, warehouse or other such structure. Once installed, the device 10 can be paired with any number of external devices utilizing the above described communication unit. For example, the device can be paired with a cellular telephone, tablet or other such device that is running a mobile application (App).

As the device 10 is intended to operate for long periods of time without alarm conditions, the system controller can include power management functionality for allowing a user to visually check the power level of the device and to set custom alerts. For example, the App 5 and/or display 35*b* can show the current battery life percentage at all times, or upon actuation of one of the buttons 35*a*, for example. Such a feature allows a user to replace the battery before it dies, as opposed to only performing an audible beep when the battery is almost dead.

Additionally, the system can allow a user to instruct the alarm unit to generate a specific notification upon the battery reaching a predetermined power level. For example, the speaker can chirp and/or the lights can blink once every 2 hours when the battery is at 10% power level. Of course, other notifications and power level indications are contemplated. Likewise, the system can include functionality for allowing a user to pause or delay low battery notifications. For example, by pressing one of the buttons 35*a* and/or selecting an option on the App, the above noted battery alarm can be paused for 5 hours. This functionality can be suspended when the battery reaches a critical level (e.g., below 5%) or upon other user-specified criteria (e.g., after 5-10 pauses).

Next, if/when the detection unit 20 identifies the presence of a hazardous condition, the device 10 can immediately trigger the alarm unit to notify occupants within the vicinity of the device 10. Again, this notification may include one or both of an audible sound and/or visual indicator using the lights 15*b* and display 35*b* that can identify the specific hazardous condition detected.

Simultaneously with the alarm activation, the communication unit 20 can send a notification to any number of external devices such as the paired phone or tablet via the App. In one embodiment, the communication unit can activate the onboard cellular transceiver to provide a voice or data notification to any number of pre-designated contacts such as the building owner, first responders and/or a third-party safety system. To this end, the system can include functionality for contacting different contacts based on the type of detected substance. For example, activation of the heat or smoke alarm can cause the device to automatically dial the fire department or 911, whereas detection of propane or natural gas may cause the device to automatically dial 911 along with the gas provider.

In either instance, the information distributed from the device 10 may contain the exact nature of the harmful substance that was detected and/or the exact location where the substance was detected along with any number of other information to aid first responders and/or the designated contact.

In one embodiment, the device 10 and/or the associated App can include functionality for allowing an App user to cancel the alarm and/or notification to third parties via the communication unit. Such a feature is advantageous in instances where the user is aware of the nature of the alarm and are already taking control of the situation. For example, if the smoke alarm is activated due to overcooked food.

As described herein, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "unit" includes specified components and equivalents that are grouped together to perform a specified task. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A hazardous condition detection device, comprising:

a main body that is configured to be secured onto a building wall or ceiling;

an alarm unit that is positioned within the main body, said alarm unit being configured to generate at least one of an audible or visual alarm notification;

a detection unit that is positioned within the main body, said detection unit being configured to detect a presence of a hazardous condition;

a battery;

a controller having a wireless interface that is positioned within the main body, said controller including functionality for receiving a notification from the detection unit and activating one or both of the alarm unit and the wireless interface; and a mobile application for execution on a processor enabled device, said application being encoded with instructions for allowing the processor enabled device to communicate with the wireless interface of the controller, wherein the controller further includes functionality for monitoring a power level of the battery, and for selectively operating the alarm unit when the power level is beneath a user defined threshold, and said controller further including functionality for communicating a type of hazardous condition present in the notification transmitted to the mobile application, and for simultaneously transmitting a notification containing the type of hazardous condition present to a third party device.

2. The device of claim 1, wherein the controller includes functionality for communicating a type of hazardous condition present in the notification transmitted to the mobile application.

3. The device of claim 2, wherein the mobile application includes functionality for deactivating the alarm unit on the main body upon receipt of the notification.

4. The device of claim 1, wherein the detection unit comprises:

at least one of a smoke detection sensor, a heat detection sensor, a carbon monoxide detection sensor, a radon detection sensor, a natural gas detection sensor, and a propane gas detection sensor.

5. The device of claim 1, wherein the detection unit comprises:

at least two of a smoke detection sensor, a heat detection sensor, a carbon monoxide detection sensor, a radon detection sensor, a natural gas detection sensor, and a propane gas detection sensor.

6. The device of claim 1, wherein the detection unit comprises:

at least three of a smoke detection sensor, a heat detection sensor, a carbon monoxide detection sensor, a radon detection sensor, a natural gas detection sensor, and a propane gas detection sensor.

7. The device of claim 1, wherein the detection unit comprises:

each of a smoke detection sensor, a heat detection sensor, a carbon monoxide detection sensor, a radon detection sensor, a natural gas detection sensor, and a propane gas detection sensor.

8. The device of claim 1, wherein the alarm unit comprises both a speaker and at least one light.

9. The device of claim 8 wherein the controller includes functionality for instructing the speaker to communicate a type of hazardous condition detected by the detection unit.

10. The device of claim 1 wherein the mobile application is encoded with instructions for showing the power level of the battery.

11. The device of claim 10 wherein the mobile application is encoded with instructions for providing an audiovisual alert on the processor enabled device when the power level of the battery is beneath a user defined threshold.

12. The device of claim 1, wherein the mobile application includes functionality for deactivating the alarm unit on the main body upon receipt of the notification, and for cancelling the notification to the third party device.

* * * * *